US005779113A

United States Patent [19]

Huang

[11] Patent Number: 5,779,113

[45] Date of Patent: Jul. 14, 1998

[54] WATCH HOLDER SYSTEM

[76] Inventor: Chen-Chung Huang, No.197, Ta Chu Wei, Lu Chu Hsiang, Tao Yuan Hsiene, Taiwan

[21] Appl. No.: 771,672

[22] Filed: Dec. 23, 1996

[51] Int. Cl.[6] ..... A44C 5/00

[52] U.S. Cl. ..... 224/172; 224/175; 224/217; 224/903; 368/282; 63/3.1; 63/11

[58] Field of Search ..... 224/175, 217, 224/218, 164, 172, 903; 24/580, 584; 368/281, 282, 316, 276; 63/3.1, 3, 5.1, 11

[56] References Cited

U.S. PATENT DOCUMENTS

| | | | |
|---|---|---|---|
| 601,982 | 4/1898 | Peirson | 224/903 |
| 1,628,278 | 5/1927 | Scheuer | 224/217 |
| 2,926,825 | 3/1960 | Wing | 224/903 |
| 3,484,907 | 12/1969 | Elsenheimer | 24/580 |

FOREIGN PATENT DOCUMENTS

| | | | |
|---|---|---|---|
| 618 601 | 12/1926 | France | 224/172 |

*Primary Examiner*—Linda J. Sholl
*Attorney, Agent, or Firm*—Connolly & Hutz

[57] ABSTRACT

The present invention relates to a watch holder system, which is worn on the back side of a hand, comprising a casing, an elastic cord, and a buckle. The casing is provided with two holes passing through from the front end to the back end and accommodating the elastic cord. The lower side of the casing is concave to match the surface of the back side of the hand. By the wearing position of the watch holder system, a novel and beautiful effect is created. In use, the watch will not be covered by a long sleeve, thus allowing for unhindered reading of the displayed time.

1 Claim, 3 Drawing Sheets

WATCH HOLDER SYSTEM

BACKGROUND OF THE INVENTION

1. Field of the Invention

The present invention relates to a structure for holding a watch, particularly to a structure with an elastic cord surrounding a casing, containing the watch, and a buckle for holding the watch on the back of the hand, so as to give the watch a novel creative quality.

2. Description of Related Art

Commonly used clocks for personal use can be divided into wrist watches and pocket watches. They serve not only as indicators of time, but also as decoration to distinguish the wearer. Conventional watches that are worn on the wrist are often covered by the clothes of the wearer, particularly by long sleeves, such that their design and beauty remains invisible. Then looking at the watch to read the time display is uncomfortable, too. Other conventional watches are provided with a clip on the backside of their casing, so as to be fixed to clothes or backpacks. Still other conventional watches are embellished at the transition between the upper and lower half of the casing and the strap. The back of the hand, however, is not decorated by such watches. For beauty-conscious designers and watch bearers, conventional watches are out of fashion. So there is some demand for a novel way to carry watches, which is both fashionable and comfortable.

SUMMARY OF THE INVENTION

The main object of the present invention is to provide a watch holder system for a novel way to carry a watch. The system comprises a casing, an elastic cord, and a buckle. The casing has long holes passing through from the front end to the back end, which accommodate the elastic cord. The back side of the casing is concave, so as to match the shape of the back of the hand. The position of the casing on the back of the hand is adjustable, such that the watch holder system of the present invention adapts to any wearer's hand. The design of the watch is shown, without being covered by a sleeve, and the time display is read without extra effort.

The present invention can be more fully understood by reference to the following description and accompanying drawings.

DETAILED DESCRIPTION OF THE PREFERRED EMBODIMENTS

Figure 1:
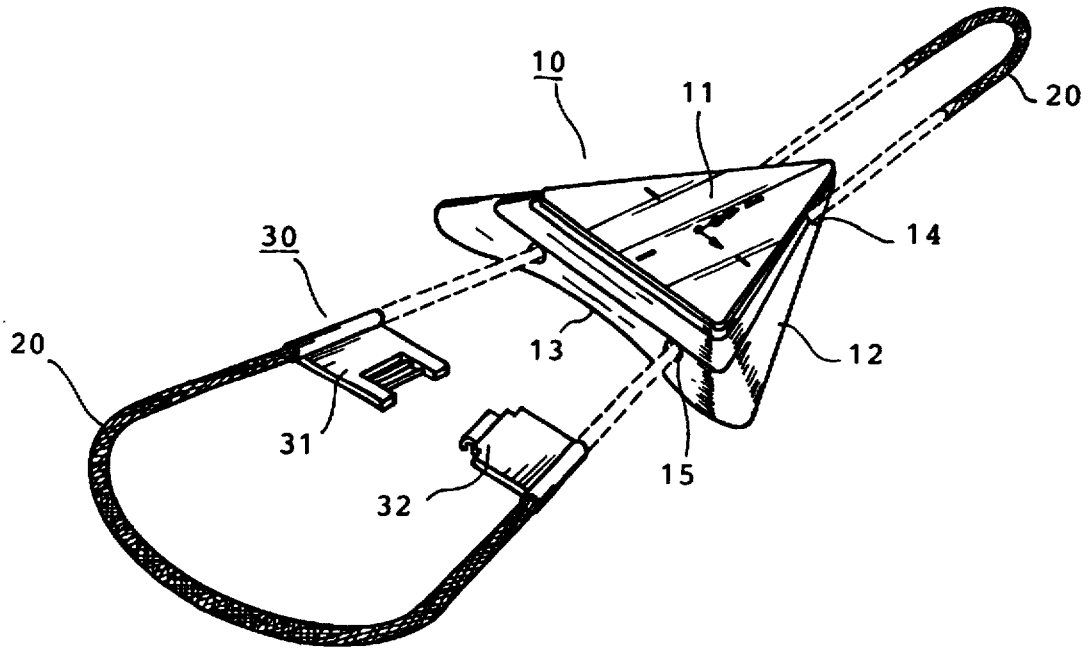
FIG. 1 is a perspective view of the watch holder system of the present invention.
Figure 2:
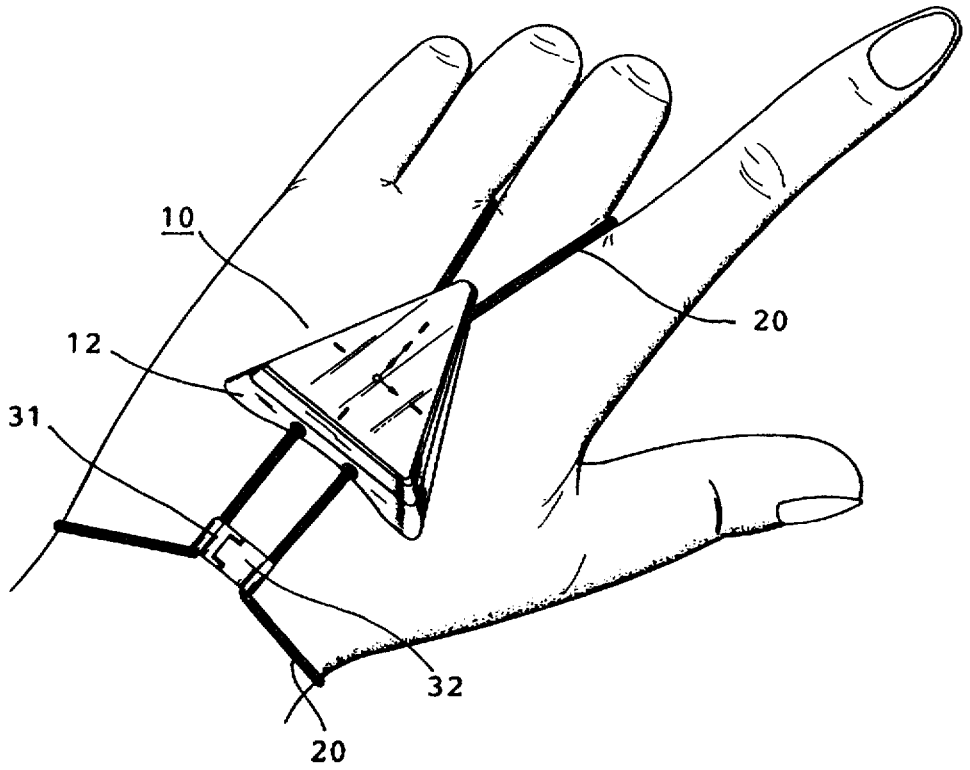
FIG. 2 is a schematic illustration of the use of the present invention.

As shown in FIGS. 1 and 2, the watch holder system of the present invention comprises a casing 10, an elastic cord

20, and a buckle 30. The casing 10 is the enclosure of the watch mechanism, with a face 11 on the upper side showing the time. The casing 10 may be shaped in various forms, e.g., like a prism, a plum flower or a star. On the lower side of the casing 10, next to the hand of the wearer, a support plate 12 is attached. The support plate 12 is passed through by two holes 14, 15, which are parallel to the face 11 and range from the front end of the support plate 12, pointing towards the fingers, to the back end thereof. The elastic cord 20 passes glidingly through the holes 14, 15. The support plate has a lower surface 13 next to the hand of the wearer. The lower surface 13 is concave, so as to adapt to the curvature of the wearer's back surface of the hand.

The elastic cord 20 is made of elastic material. It passes glidingly through the holes 14, 15, such that the position of the casing 10 on the back of the hand is variable. The elastic cord 20 forms an endless loop, with a front loop and a back loop extending from the casing 10. The front loop is laid around the middle finger, and the back loop is laid around the wrist, thus creating a unique and beautiful sight of the watch.

The buckle 30 comprises a hold 31 with a bar and a hook 32, which hooks into the bar of the hold 31, when the buckle is closed. The hold 31 and the hook 32 are attached to the two sides of the back loop of the elastic cord 20, leaving an end loop that allows the wrist to pass through and hold the cord, when the buckle is closed.

Figure 3:
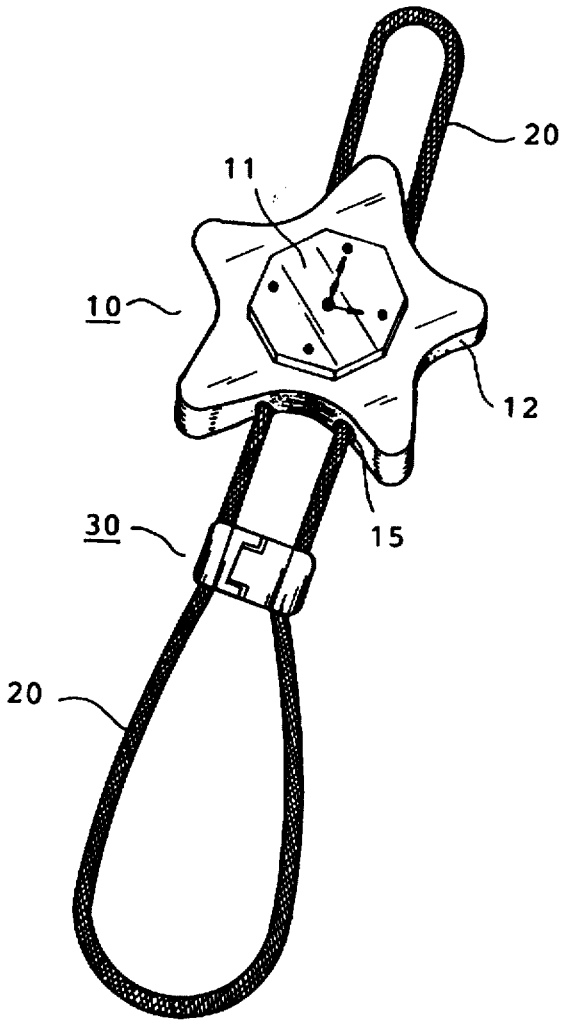
FIG. 3 is a perspective view of the watch holder system of the present invention in another embodiment.

Referring to FIG. 3, in another embodiment of the present invention, the support plate 12 of the casing 10 is shaped like a star. The elastic cord 20 holds the watch on the back of the hand, giving a novel and beautiful effect. The buckle 30 is a latch having the hold 31 and hook 32. The watch holder system of the present invention and the way to wear it ensures easy reading of the displayed time, without any piece of clothing blocking the sight.

What is claimed is:

1. A watch holder system for holding a watch on the back side of a hand, comprising:

a casing having a face and a support plate, an elastic cord, and a buckle having a hold and a hook;

the improvement comprising:

said support plate being attached on the lower side of said casing and being passed through by two holes paralleling to said face and ranging from a front end of said support plate to a back end thereof, said support plate having a concave lower surface to adapt to the curvature of said hand, said elastic cord being endless and passing glidingly through said two holes to form a front loop and a back loop extending from said casing, and said hold and said hook of said buckle being attached to the two sides of said back loop of said elastic cord.

* * * * *